United States Patent [19]

Natale

[11] Patent Number: 4,626,291

[45] Date of Patent: Dec. 2, 1986

[54] PORTABLE CONTAINMENT DEVICE FOR TREATMENT OF HAZARDOUS MATERIALS

[76] Inventor: Thomas Natale, 99 Ivy Ave., Moorestown, N.J. 08057

[21] Appl. No.: 777,560

[22] Filed: Sep. 18, 1985

Related U.S. Application Data

[63] Continuation of Ser. No. 543,850, Oct. 20, 1983, abandoned.

[51] Int. Cl.[4] ..... B08B 5/04

[52] U.S. Cl. ..... 134/21; 15/227; 312/1; 312/3; 128/1 R; 128/1 B; 138/97; 98/115.1; 98/115.3; 98/115.4

[58] Field of Search ..... 134/6, 10, 21, 42; 15/227; 98/115 LH, 115 R, 115 S B; 55/DIG. 29, DIG. 46; 312/1, 3; 128/1 R, 1 B; 138/97

[56] References Cited

U.S. PATENT DOCUMENTS 3,051,164 8/1962 Trexler ..... 128/1 B X
3,802,416 4/1974 Cazalis ..... 128/1 B X
4,108,509 8/1978 Piet et al. ..... 312/1
4,335,712 6/1982 Trexler ..... 128/1 B X

FOREIGN PATENT DOCUMENTS 1567270 5/1980 United Kingdom .

OTHER PUBLICATIONS

Guidance for Controlling Friable Asbestos-Containing Materials in Buildings, EPA Report No. 560/5-83-002, Mar. 1983.

Controlling Asbestos Contamination with Negative Air Filtration Systems, by PEDCo Environmental, Inc., Apr. 1982.

*Primary Examiner*—Andrew H. Metz
*Assistant Examiner*—Sharon T. Cohen
*Attorney, Agent, or Firm*—Fleit, Jacobson, Cohn & Price

[57] ABSTRACT

A containment bag system specifically adapted for the removal of asbestos insulation from asbestos covered pipes and valves without contamination of the worker or the surrounding environment; a method of removing asbestos and other hazardous materials from limited areas using a safe containment system; a method for manufacturing the containment system.

10 Claims, 4 Drawing Figures

PORTABLE CONTAINMENT DEVICE FOR TREATMENT OF HAZARDOUS MATERIALS

This application is a continuation of application Ser. No. 543,850, filed Oct. 20, 1983, now abandoned.

FIELD OF THE INVENTION

This invention relates to the removal of asbestos or other hazardous materials from an area of limited contamination, to a portable containment and disposal device for use during such removal, and to a method for manufacturing such device.

BACKGROUND OF THE INVENTION

Asbestos-containing pipe insulation takes many forms, including chalky mixtures of magnesia and asbestos, preformed fibrous asbestos wrapping, asbestos fiber felt, corrugated paper, and insulating cement. In most cases, the insulating material is covered with a protective jacket (lagging) made of cloth, tape, paper, metal or cement. Occasionally, asbestos millboard is used as outside lagging on removable insulating covers for stiffness. Lagging on pipes and boilers prevents spontaneous fiber release and helps protect against disturbance.

Exposure to airborne asbestos regardless of the level, involves some health risks. When damage occurs to asbestos insulation and lagging on pipes and valves, repair and/or removal of the material is essential. The potential for exposure to airborne asbestos during such operations cannot be ignored. Worker protection is essential and is, in general, demanded by law. Proper work area containment is highly recommended for all abatement techniques. Once abatement work begins, all uninvolved persons should be kept out of the area.

Containment typically means construction of barriers with 6 mil polyethylene plastic sheets joined with folded seams, and with sealing tape at the seams and boundaries. Air locks and worker decontamination facilities with showers are recommended. So, too, are negative air pressure systems. Without adequate containment, increased exposure for building occupants is likely. Abatement activities should be conducted during vacations or other times when few people are in the building.

The cost of containment in such circumstances may equal or, indeed, exceed the cost of abatement. Further, it still requires that workers enter the containment area in order to conduct the abatement operation. Finally, it should be noted that the removal of the asbestos insulation from the pipes and valves still requires safe packaging of the material for removal from the containment area for ultimate disposition.

It is an object of this invention to provide a containment device which will be relatively inexpensive compared to general containment procedures of the past.

It is another object of this invention to provide a method of constructing a device suitable for asbestos and other hazardous material containment.

A further object of this invention is to provide a method for removing contaminates such as asbestos from pipes and valves in which the worker is protected and in which the cost of abatement is significantly reduced through reduced costs in containment and disposition of the final debris of the abatement procedure.

These and other objects will be apparent from the subsequent disclosure and appended claims.

SUMMARY OF THE INVENTION

A containment bag is sealed around the area of hazardous material to be treated or removed. Armholes and an inside pouch for tools allow the worker to remove the hazardous material without exposure to the material. A sealed side port allows access for wetting the hazardous material and for evacuating the bag with a suitable vacuum device.

DETAILED DESCRIPTION OF THE INVENTION

Figure 1:
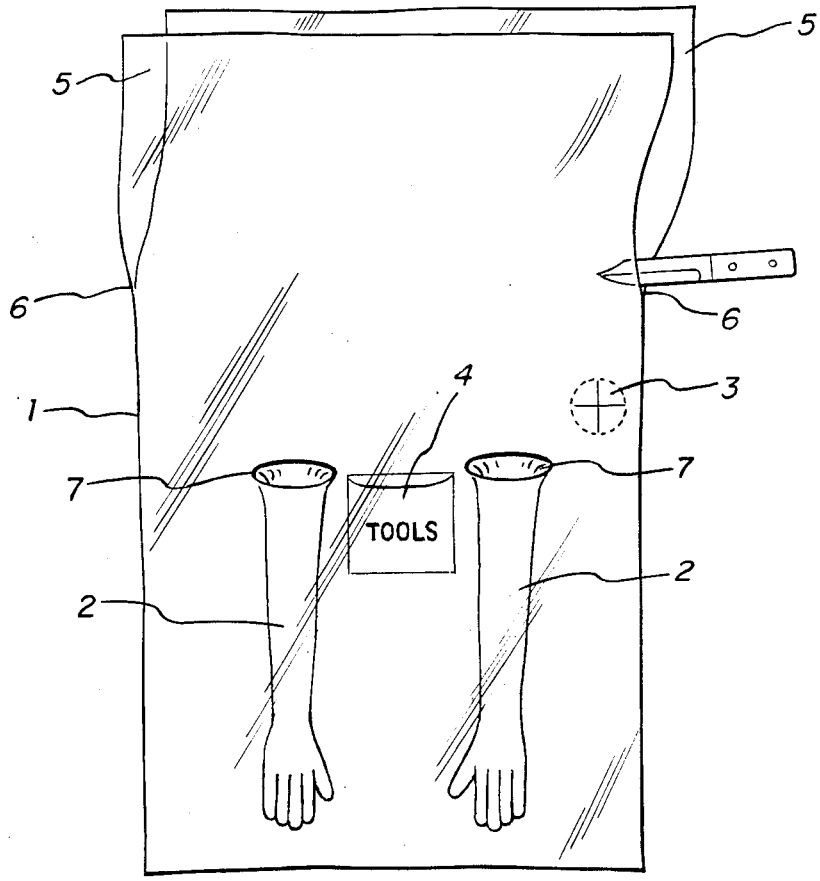
FIG. 1 is a schematic drawing of the containment device of the present invention.

With reference to the drawings, and in particular with reference to FIG. 1, the containment device of the present invention comprises a flexible, generally transparent, plastic bag 1, open at one end, equipped with sealed gloves 2 for hand access to interior of the bag, a sealed side port 3 to allow access to a suitable wetting device and/ or vacuum device, and an interior tool pouch. The open end of the bag is provided with flaps or is slit to provide flaps 5; the side inlet port 3 is positioned generally between the terminal points 6 of the flaps and the connection point 7 for the sealed gloves. A tool pouch 4 is positioned generally between the two gloves 2 at a point not higher than the level of attachment of the gloves. It should be noted that in this description, the terms "higher" and "lower" are relative to the position in which the bag would normally be used, with the closed end of the bag at the boftom and the open end of the bag at the top.

Figure 2:
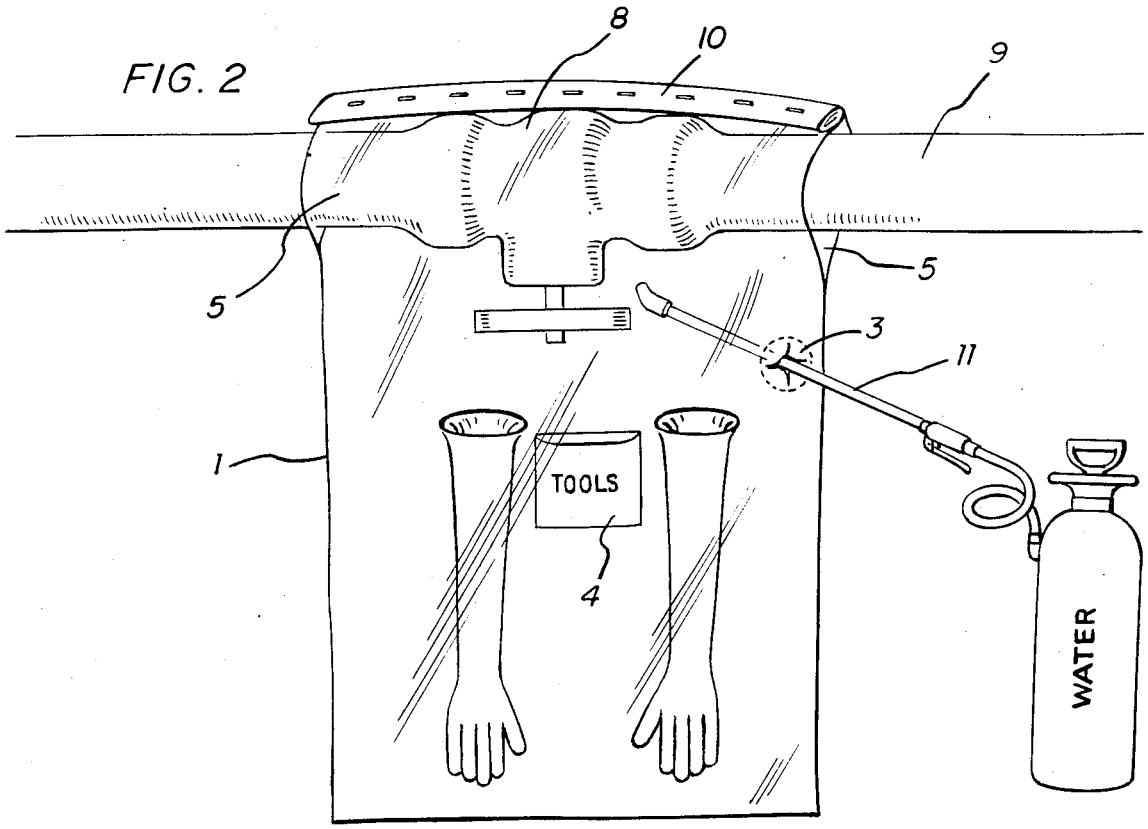
FIG. 2 is a schematic diagram of the containment device in position around an asbestos insulated valve with an appropriate wetting device in place to wet the asbestos insulation.

The invention will be described in detail with respect to the removal of asbestos insulation from an insulated valve. Such a valve is shown as 8 in the schematic drawing of FIG. 2. If the containment bag is not precut, the sides of the bag are cut from the top a sufficient distance to accomodate the pipe 9 and valve 8 to be treated. Any tools that will be needed for working on the insulation should be inserted in the tool pouch 4 or, if there is no tool pouch, in the bottom of the containment bag 1. The bag 1 is then placed around the pipe 9 and valve 8 with the cut flaps 5 overlapping. The open edges of the flaps are then folded together until the bottom of the slit sides is close enough to the bottom of the pipe 9 to permit sealing. The folded edges of the flap 5 are then sealed with staples and tape and such additional support as might be needed to provide seam 10. This seam will, in effect, support not only the weight of the bag but any material placed in the bag including the accumulated debris from removal of the insulation. The sealed side port 3 can then be opened for the insertion of a wetting tube 11; water or other suitable liquid is sprayed onto the asbestos surface to be treated, in accordance with standard practices, to reduce dust. Either before or after wetting of the area, the edges of the bag around the working area are sealed, for example with tape, to form a reasonably tight seal (such a seal is shown as 12 in FIG. 3). This seal should, of course, be as tight as reasonably possible, but need not be a total seal.

Figure 3:
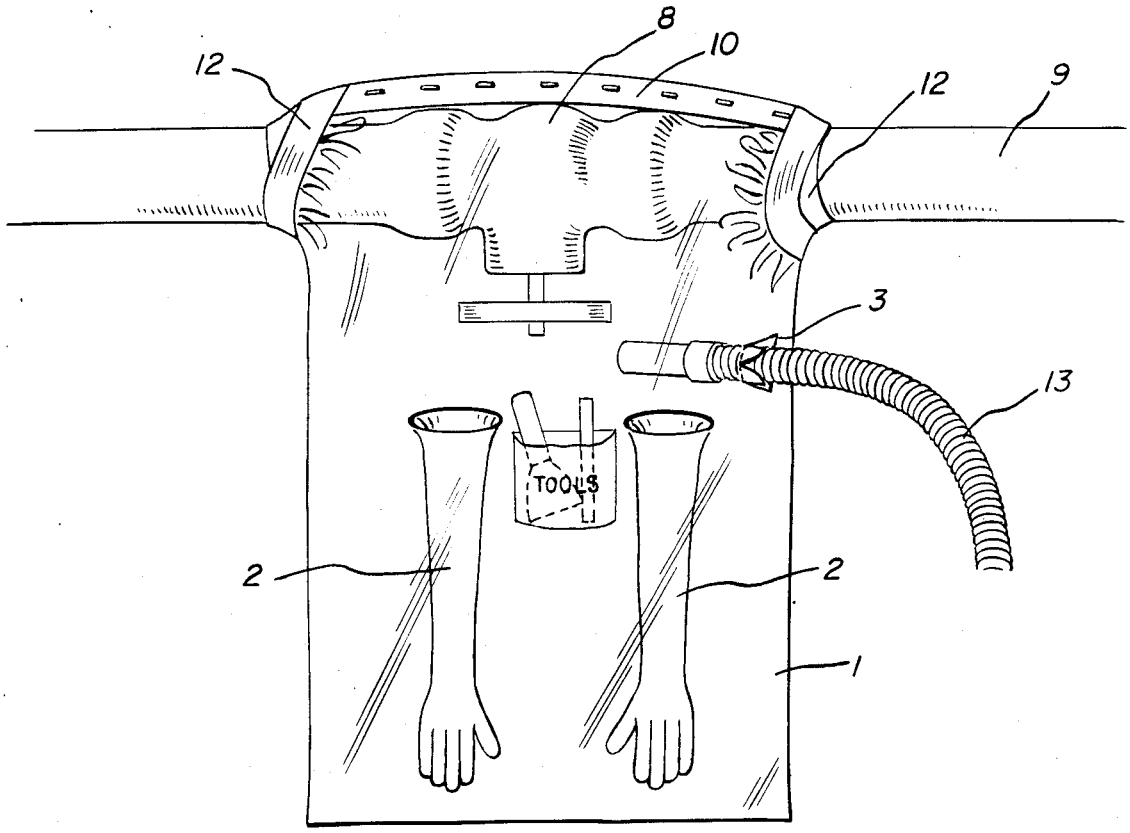
FIG. 3 is a schematic drawing in which the containment device is sealed around an insulated valve with an appropriate vacuum device in place and sealed to the containment device.

As is shown in FIG. 3, before asbestos removal a suitable vacuum device 13 (having a filter efficiency of 99.95% at 0.3 microns or better) is inserted through the side port and sealed in place. Preferably, throughout the asbestos removal operation, a negative pressure is maintained so that if there is any leakage around seals 12, there will be an inflow of air rather than an outflow of asbestos fiber contaminated air. Suitably the vacuum device 3 can be sealed to the containment bag 1 with tape.

Figure 4:
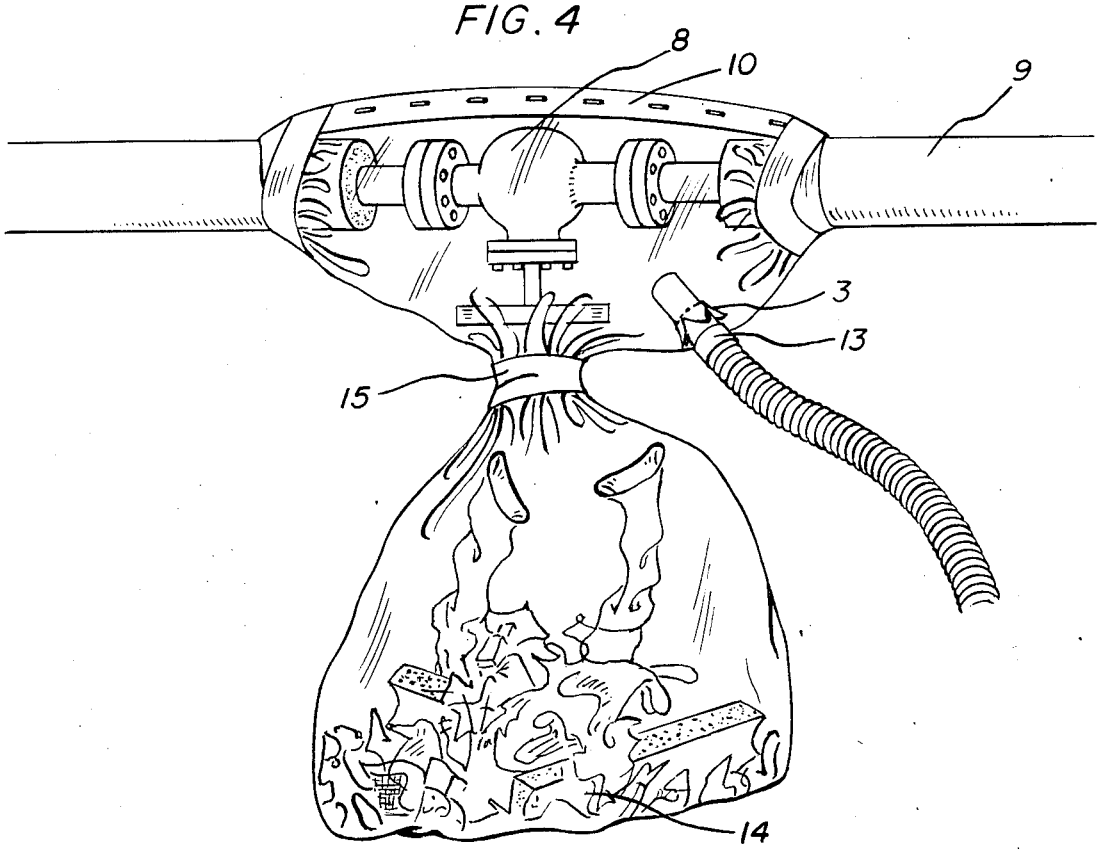
FIG. 4 is a schematic drawing of the containment device at the conclusion of asbestos insulation removal from the valve, in which the containment is collapsed by vacuum and the asbestos detritus is isolated in the lower section of the containment device.

With the vacuum device 13 in place, the worker inserts his arm and hands into the armholes and gloves 2, and proceeds to remove the asbestos from the valve fitting 8 and pipe 9. As noted previously, it is desirable but not essential to maintain a slight vacuum on the system. When the asbestos removal job has been completed, however, the vacuum device 13 should be operated at full vacuum to remove air from the bag 1 to the point of causing partial collapse of the bag. The bag 1 is then squeezed tightly as close to the top as possible, but below the vacuum device entry into the bag at 3, and twist-sealed and taped shut to keep the asbestos debris material safely at the bottom of the bag. This condition is illustrated in detail in the drawing of FIG. 4 in which the debris is shown as 14 at the bottom of the bag and the center of the bag is sealed at 15. The vacuum device 13 is allowed to run for a short period after sealing to insure that any airborne particles are removed from the section of the device above the seal 15. At this point vacuum device 13 can be turned off and the vacuum device hose 13 removed from the port 3; the side port 3 is then sealed with staples and tape for safety. The top of the containment bag may now be cut and the bag removed from the working area and placed into another plastic bag for proper disposal. The vacuum device can now be used to vacuum the surface of the work area to remove any remaining particulates; the cut and exposed edges of the asbestos insulation can now be removed.

Where long sections of pipe are cleansed of asbestos insulation, it may not be necessary to remove the containment bag after only a single use. For a typical use, the containment bag is designed to cover about a three foot length of pipe. When the pipe is cleaned, the bag can be slid to the next section and another section of three feet can be cleaned. The bag will always be anchored on a clean pipe at one end and an unbroken asbestos covering surface at the other with any debris removed in between collected at the bottom of the bag.

While not intended as a limitation it should be noted that the preferred embodiment of the present invention utilizes a 6 to 7 mil clear polyethylene bag measuring approximately 44" wide and 63" long as the containment bag. The armglove combination is preferably made from DuPont Tyvek® arms with latex gloves. These can be sized to order if needed.

The bag can be produced by heat sealing one end of an appropriate length of polyethylene lay-flat tubing. A tool pouch is formed also by heat sealing or otherwise laminating a "patch" of polyethylene film to the inside surface of the containment bag, the seal occurring on three sides of the patch, the fourth side remaining open toward the top for the admission of tools or other materials. An oval, thermal pressure-and-shaping device, approximately 6" in overlength and ¼" thick is used for attaching the Tyvek® armsleeves. The armsleeve with glove attached is positioned inside the tube portion of the shaping device with the top edges of the sleeve folded over the outside of the device. The bag is then laid on top of the sleeve and heat sealed with a flat surface heating element; a sheet of paper is placed in between to avoid adhesion of the heating element to the film. The methods of attaching the Tyvek® sleeve to the latex glove are standard.

Accordingly, the present invention allows an individual to work along a length of asbestos-covered pipe without contaminating himself or the surrounding room. All asbestos debris removed or disturbed by the task is contained in the sealed bag. A single bag may be used for work on a substantial length of pipe. After the first three foot section is cleared, the bag is slid into the adjacent section where the process is repeated. When the job is completed or the bag is full with debris, the bag is tied off close to the pipe, sealing in all asbestos; removed from the pipe, and is then disposed of in the proper fashion.

Asbestos removal contractors have found the devise particularly useful for handling asbestos often found on single pipes running across a room in schools or other such facilities. Use of the bag avoids the costly and time-consuming process of sealing, and later cleaning, the entire room.

The new EPA asbestos control guide lines issued in May, 1983, advise that "Containment bags with sealed holes for hand access are alternatives to full room or full work area containment." ("Guidance for Controlling Friable Asbestos-Containing Materials in Buildings," EPA.) NIOSH's Division of Physical Sciences and Engineering reported in May, 1983, that, "If asbestos is present, it is necessary to . . . minimize exposure to a known carcinogen. In some cases, tasks can be accomplished in a completely enclosed bag that is disposed of, along with the small amount of waste involved." ("Control Technology For Asbestos Removal Contractors", NIOSH.)

Thus it may be seen that the present invention provides a substantial advance in the art of asbestos and other hazardous material removal providing both safety to the worker and reduced cost ot the contractors and parties being serviced.

It should be understood that changes may be made in the details of construction, arrangement or operation of the present invention without departing from the spirit of the invention.

I claim:

1. A disposable device adapted for receiving asbestos insulation and like hazarous materials, said disposable device comprising:

a length of lay-flat tubing forming a bag, said bag being flexible and collapsible and including two sides, two side edges formed by opposed folds of said bag, said two side edges joining said two sides together, a top edge of said bag and a bottom edge of said bag, said two side edges extending substantially parallel to each other from said top edge of said bag to said bottom edge of said bag, said top edge and said bottom edge extending substantially parallel to each other and extending substantially perpendicular to said two side edges, said bottom edge being sealed to close off a bottom of said bag and said top edge having an opening for entry of said asbestos insulation and like hazardous materials into the interior of said bag, and glove means sealed to one of said two sides of said bag for protected access to the interior of said bag from the exterior of said bag.

2. A device in accordance with claim 1, wherein said glove means includes two arm holes defined by one of said two sides of said bag and a glove is attached to each of said two arm holes.

3. A device in accordance with claim 2, further comprising a tool pouch affixed to an inner surface of said one side of said bag, intermediate said two arm holes and located between said two arm holes and said bottom edge of said bag.

4. A device in accordance with claim 3, wherein said bag is formed from 7 mil polyethylene.

5. A device in accordance with claim 2, further comprising means for introducing negative air pressure into said bag during removal of said hazardous material.

6. A device in accordance with claim 1, wherein said two side edges are slit from said top edge to provide opposed flaps at said first end.

7. A device in accordance with claim 1, wherein said disposable device is used in combination with structural means having asbestos insulation thereon, said bag surrounding and extending below at least a portion of said structural means and defining a sealed enclosure, said sealed enclosure receiving and retaining the asbestos insulation removed from said structural means for disposal without subjecting said asbestos insulation to the open atmosphere.

8. A device in accordance with claim 7, wherein said bag is collapsed and sealed below said at least a portion of said structural means when said sealed enclosure has received the asbestos insulation from said structural means.

9. In combination for removal of asbestos insulation and like hazardous material, said combination comprising:

(a) structural means having asbestos insulation thereon, (b) flexible bag means surrounding and extending below at least a portion of said structural means and defining a sealed enclosure, (c) said flexible bag means including a length of lay-flat tubing having substantially parallel side edges formed by opposed folds of said tubing, substantially parallel top and bottom edges extending substantially perpendicular to said side edges and said flexible bag means further including at least one arm hole and one glove sealed thereto and extending into said sealed enclosure, (d) means defined by said flexible bag means for access of at least one of a tubular wetting device and a vacuum device into said bag, and (e) said sealed enclosure receiving and retaining the asbestos insulation removed from said structural means for disposal without subjecting said asbestos insulation to the open atmosphere.

10. The combination as claimed in claim 9, wherein said flexible bag means is collapsed and sealed below said at least a portion of said structural means when said sealed enclosure has received the asbestos insulation from said structural means.

* * * * *